United States Patent [19]

Saito et al.

[11] Patent Number: 4,676,439

[45] Date of Patent: Jun. 30, 1987

[54] PULVERIZING AND PARTICLE-SIZE CLASSIFYING APPARATUS

[75] Inventors: Katsuichi Saito, Nagaoka; Shokichiro Yoshikawa, Tokyo; Akira Hirai, Kamakura, all of Japan

[73] Assignee: Miaski Shipbuilding and Engineering Co., Ltd., Tokyo, Japan

[21] Appl. No.: 829,747

[22] Filed: Feb. 18, 1986

Related U.S. Application Data

[63] Continuation of Ser. No. 582,682, Feb. 23, 1984, abandoned.

[30] Foreign Application Priority Data

| | | | |
|---|---|---|---|
| Mar. 1, 1983 | [JP] | Japan | 58-31850 |
| Mar. 1, 1983 | [JP] | Japan | 58-31851 |
| Nov. 22, 1983 | [JP] | Japan | 58-179524 |

[51] Int. Cl.[4] ..... B02C 17/10

[52] U.S. Cl. ..... 241/172; 241/176

[58] Field of Search ..... 241/171, 172, 176, 179

[56] References Cited

U.S. PATENT DOCUMENTS

| | | | |
|---|---|---|---|
| 1,894,106 | 1/1933 | Lehrack | 241/172 |
| 2,416,746 | 3/1947 | Gavin | 241/172 X |
| 3,441,226 | 4/1969 | Bargero | 241/171 X |

FOREIGN PATENT DOCUMENTS

| | | | |
|---|---|---|---|
| 1227768 | 10/1966 | Fed. Rep. of Germany | 241/176 |
| 698652 | 11/1979 | U.S.S.R. | 241/176 |
| 880482 | 1/1982 | U.S.S.R. | 241/172 |

*Primary Examiner*—Howard N. Goldberg
*Assistant Examiner*—Joseph M. Gorski
*Attorney, Agent, or Firm*—Beveridge, DeGrandi & Weilacher

[57] ABSTRACT

A ball mill comprising a horizontal mill casing provided with means of magnetizing-force generation which are identically constructed and equidistantly spaced electromagnets forming a plurality of electromagnet rows, fixed in space, equally spaced apart and extending from one end to the other of the casing within two angular zones fixed in space, first from 135° to 180° and second from 225° to 360°, thus presenting a plurality of magnet columns in circular direction, and which is provided with a switching circuit network for keeping the electromagnets of the lowermost row in the second zone in energized state and energizing and de-energizing all other electromagnets alternately and cyclically in two groups, such that every electromagnet of one group is sided, in crisscross directions through row and column, by electromagnets of the other group.

1 Claim, 19 Drawing Figures

1
2
3
4
5
20
21
22
24
25
26
27
28
29
30
31
32
33
34
40
41
42
43
44
45
46
47
48
50
51
52
53
54
56
57
S
II

PULVERIZING AND PARTICLE-SIZE CLASSIFYING APPARATUS

REFERENCE TO A RELATED APPLICATION

This is a continuation of copending application Ser. No. 582,682 filed Feb. 23, 1984, now abandoned, which is relied on and incorporated herein by reference.

This invention relates to a pulverizing apparatus, especially a ball mill for use in a particle-size classifier for producing extremely fine particles.

Although the apparatus according to this invention is not limited to specific industrial pulverizing purposes, it is especially suited to the production, in a once-through continuous process, of fine ceramic particles, on the order of several microns in particle size, for use as a material in production of articles such as gas turbine blades fabricated by powder metallurgical techniques or of dopes for forming electrical circuit conductors on printed circuit boards.

Continuous or batch production of such ultra-fine particles by pulverizing a raw material in coarse-grain bulk form requires special considerations with regard to material feeding, ball-milling and size classifying devices. The reason for these special considerations resides in the fact that reduction of coarse-grain material to powdery particles is generally time-consuming; extra-fine particles are usually prone to absorb moisture and coagulate into solid lumps or, in the absence of moisture, to become suspended in the air and be flown away as dust; and such particles, which are necessarily distributed over a wide particle size range, do not readily lend themselves to size classification.

A main object of this invention is to provide a ball mill capable of readily pulverizing a raw material into extra-fine particles in a relatively short time.

Another object of this invention is to provide continuous pulverizing and classifying devices in combination with a material feeding device capable of speedy and economical micro-order comminution without exposing the pulverized particles to ambient air and readily classifying the resultant powder into sharply defined particle size subranges.

Further objects and features of this invention will be apparent from the detailed description of several embodiments which follows below and the drawings wherein:

FIG. 5(*b*) is a same graph as FIG. 5(*a*) according to this invention;

FIG. 6(*b*) is a perspective view of another ball used in this invention;

FIG. 10(*b*) is a graph showing pulses for energizing electromagnets;

Figure 1:
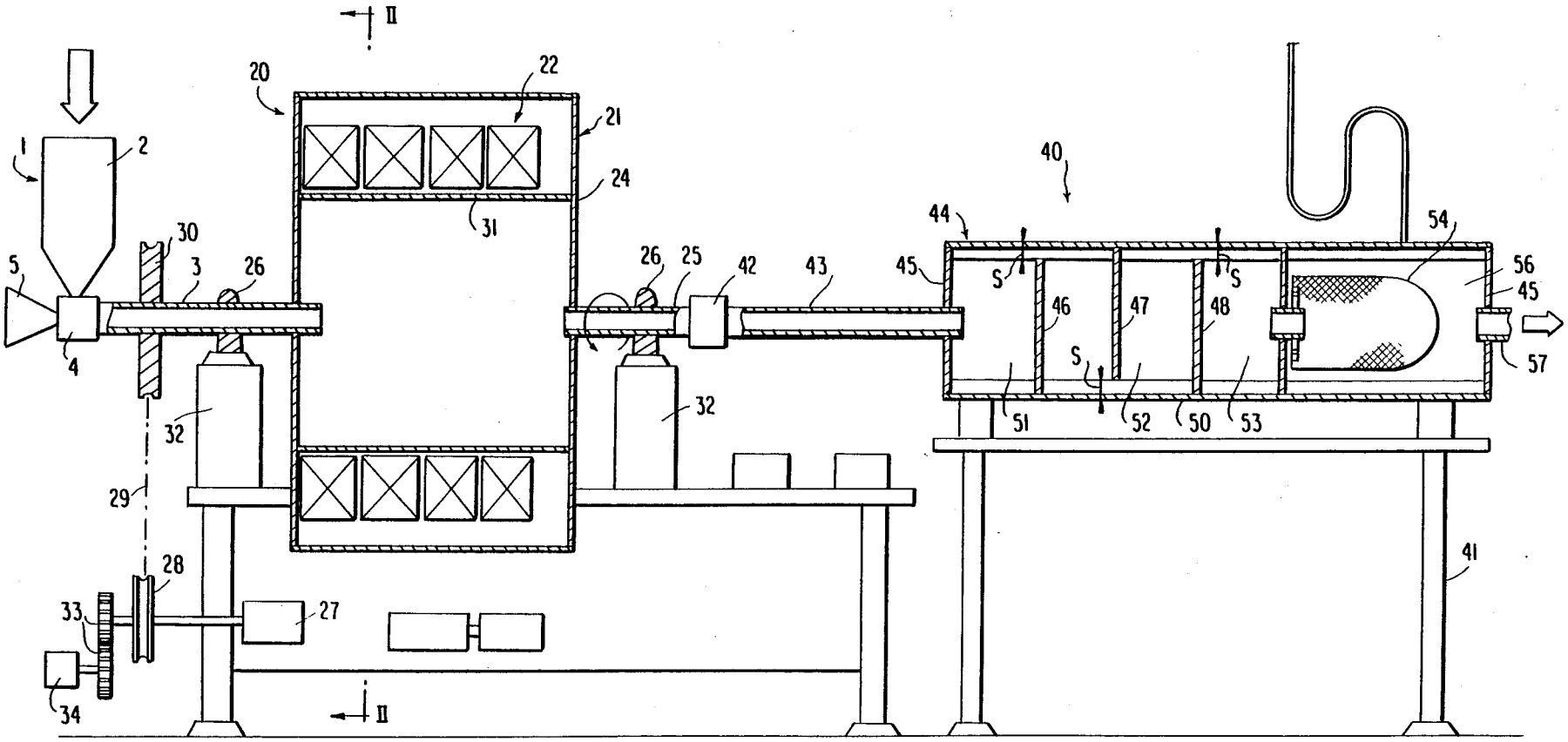
FIG. 1 is a side elevation view of a pulverizing apparatus embodying this invention.

Described in further detail, the apparatus shown as an example of this invention in FIG. 1 comprises a material feeder (1), ball mill (20) and classifier (40), arranged and coupled to each other in that order to constitute a once-through pulverizing system.

The feeder (1) is composed of a funnel-like hopper (2) having a rotary seal (4) in its bottom part and a rotary feed pipe (3) extending horizontally from said rotary seal, which is fitted with a gas valve (5) so that the bulk material to be pulverzied can be fed into the pipe (3) together with the transporting gas admitted through the valve at a pressure determined by the setting of this valve. The feeder (1) so composed is supported and held at a proper elevation by structural means not shown.

The ball mill (20) is composed of a horizontal mill casing (21) of cylindrical shape whose end plates or heads (24) are parallel to each other; magnetizing-force generating means (22) distributed around the cylindrical surface of said mill casing, and a plurality of identically constructed milling or pulverizing balls held loose and free inside the casing. The rotary feed pipe (3), coaxial with the cylindrical casing, is rigidly connected to a head (24) on the upstream side to admit the coarse-grain bulk material together with transporting gas into the casing, and a rotary discharge pipe (25), similarly integral with the downstream-end head of a cylindrical casing (44), extends toward a particle-size classifier (40) supported by supports (41).

The feed pipe (3) and the discharge pipe (25) are supported by bearings (26) mounted on appropriate pedestals or supporting means (32) so that casing (21) can be rotated on its axis with the two pipes (3) (25) acting as if they were a shaft. The weight of the casing and its charge inside is supported by these bearings.

As the means of setting the cylindrical casing in rotation, a large pulley (30) is rigidly mounted on the feed pipe (3) and a small pulley (28) on an output shaft of a drive motor (27) located at an appropriate position below the casing and feeder (1), with a driving means such as a belt (29) linking the two pulleys (28) (30) to transmit drive to the cylindrical casing.

The particle-size classifier (40) is a slender chest-like box constructed with a top plate (49), a bottom plate (50), end plates (45) and side plates (not shown), and has a horizontal inlet pipe (43) extending from the upstream-end plate (45) straight toward and in alignment with the rotary discharge pipe (25). An inlet pipe (43) is joined with the discharge pipe (25) through a rotary seal (42). An outlet pipe (57) for letting out the transporting gas from the classifier is provided on and extends out from the downstream-end plate (45). An encoder (34) is also rotated through gears (33) by the driving motor (27).

The internal space of classifier (40) is partitioned with transverse plates, numbering four in all, of which three are indicated at (46), (47) and (48), into four particle trapping chambers (51), (52), (53) and (56) in series. The three plates (46), (47) and (48) have their top or bottom edges unattached to the top plate (49) or the bottom plate (50) and thus present top bottom clearances (S), such that the mixture of pulverized particles and transporting gas entering the classifier through the inlet pipe (43) is compelled to travel or flow up and down through the successive chambers and clearances; the particles borne by the gas will fall and accumulate on the bottom of each chamber by gravity, the particles accumulating in the upstream-end chamber (51) being in the largest size subrange and those accumulating in the chamber (53) being in the smallest size subrange.

The downstream-end chamber contains a filter bag (54), which is fitted to the center opening provided in the partition plate separating the chamber (53) from the end chamber (56), in order to capture finer gas-borne particles to be used or discarded.

In the operation of the apparatus constructed and arranged as above, the material feeding action of the feeder (1), the pulverizing action of the mill (20) and the size classifying action of the classifier (40) are concurrent and coordinated to proceed in a continuous manner, with the hopper (2) continually replenished with raw material and the transporting gas continuously forced by any of known means through the gas valve (5) into the rotary feed pipe (3) while the deposits of particles in the respective chambers of the classifier (4) are withdrawn to the outside by any of known means such as a self-opening gates. Needless to say, the apparatus can be operated intermittently for batch pulverizing operation to pulverize one batch of raw material at a time. In either type of operation, the internal spaces filled with the gas are contained hermetically and isolated from outside air except at the outlet pipe (57) and, possibility, the rotary seal (4) in the bottom part of the feeder (1).

The gas emerging from the outlet pipe (57) may be piped or ducted back to the gas valve (5) through the gas pumping means (not indicated) so that the gas recirculates in a closed loop circuit. This arrangement is desirable where an expensive inert gas is used as the transporting gas in order to avoid chemical reactions between the gas and the material being pulverized.

Figure 2:
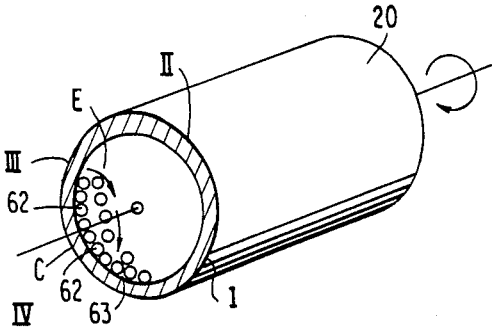
FIG. 2 is a perspective view of a mill casing according to the prior art illustrating movement of balls.
Figure 4:
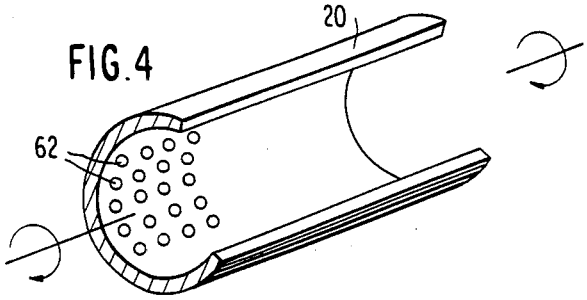
FIG. 4 is a perspective view in partial section of a mill casing illustrating movement of balls according to the prior art.
Figure 5A:
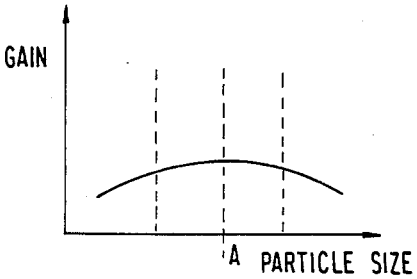
FIG. 5(*a*) is a graph showing the relation between gains and particle sizes according to the prior art.
Figure 5B:
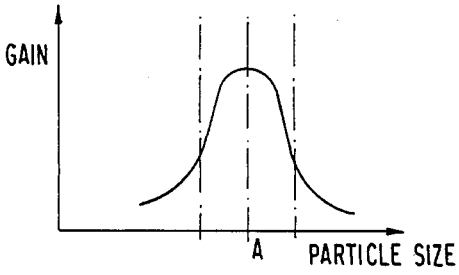

Before describing the ball mill according to this invention, it may be in order to point out the drawbacks of conventional ball mills in reference to FIGS. 2, 4 and 5(*a*).

FIG. 2 illustrates the pulverizing action in a conventional ball mill indicated in a cutaway view, the transverse section of the cylindrical casing of the mill (20) being seen through quadrants I, II, III and IV, centered on the axis of casing and fixed in space. As the casing rotates in the indicated direction, balls (62) and raw material (63) are dragged along by the inner wall of the casing and climb up the wall in quadrant IV. Just before the balls rise into quadrant III, above IV, the dragging force is overcome by gravity and consequently the balls fall back, if not crumble down, from the vicinity of point C, as do the incoming waves into a surf at the ocean beach, to the vicinity of point E, delivering impact to other balls and to the material. Note that the falling-down distance is short and the impact small and, more important, that little use is made of the wall in quadrant III, not to mention the other quadrants I and II.

Figure 3:
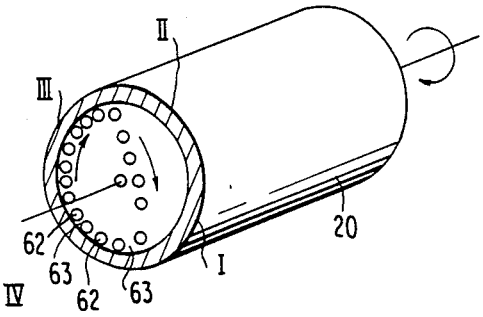
FIG. 3 is a perspective view of a mill casing according to this invention for illustrating movement of balls.

The desirable behavior of balls is illustrated in FIG. 3, in which the balls are shown as being dragged almost to the top through quadrant III and falling, as if thrown away, to land on the bottom area covering a part of quadrant I through a longer distance along a parabolic orbit: the resultant clashing impact is much greater and hence the grain crushing action is stronger. In this manner of ball behavior, however, each individual ball is little or not at all subjected to forces tending to move it sidewise, that is, in longitudinal direction inside the casing, so that the ball tends to rise and fall at a localized portion of the cylinder, as shown in FIG. 4: many localized sections in which little or no pulverizing action takes place are likely to occur. Since pulverizing action is generally accounted for not only by the impact of collision of balls but also by the shearing action of crowded balls in random motion, even the desirable ball behavior illustrated in FIG. 3 does not achieve the high efficiency of pulverization that the ball mill should be otherwise capable of.

A test, among others, of efficient pulverization is in the distribution of particles sizes in the end product. FIGS. 5(*a*) and (*b*) graphically indicate two instances of the distribution where the desired particle size is shown at A. In instance (a), the quantity of the desired particles is small while, in instance (b), it is very large. It is the particular object of this invention to provide a ball mill which overcomes the foregoing drawbacks of the conventional ball milling operations and capable of producing a large quantity of particles in a narrow size subrange centering on the desired particle size A from each unit mass of raw material in a manner represented by the curve of instance (b), so that the efficiency of pulverization will be higher and the powdery end product will be more adapted to the classifying function of the classifier (40) constructed as already described.

Figure 6A:
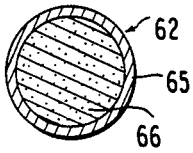
FIG. 6(*a*) is a cross section of a ball used in this invention.
Figure 6B:
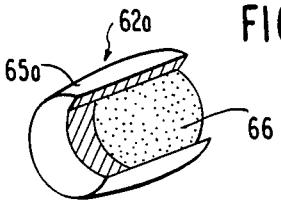

In the ball mill (20) according to this invention, the means of magnetizing-force generation are electromagnets constructed and sized identically and are controlled from a network of switching circuits (not shown) of any known kind, each circuit serving to energize and de-energize one or more electromagnets and its switch being opened and closed mechanically by means associated with the rotary motion of the cylindrical mill cylinder, in order that the pulverizing balls will move in the manner depicted in FIG. 3 without aligning themselves in an orderly array as illustrated in FIG. 4. It goes without saying that each electromagnet is positioned relative to the cylindrical casing with its magnetic axis oriented generally perpendicular to the casing surface. When the electromagnet is energized, the resultant lines of magnetic force from its inner pole will then permeate the wall of the casing and attract balls that happen to be near the pole. For this reason, the cylindrical casing is to be relatively permeable and magnetically nonretentive and made of a non-magnetic material such as 18-8 stainless steel, high-strength aluminum or reinforced plastic material, and its inner surface is to be lined with a wear-resistant material such as alumina or flint, which is permeable to the lines of force. On the other hand, the pulverizing balls (62) are to be made of a ferromagnetic material such as soft iron for its spherical core (66), as shown in FIG. 6(*a*), or its football-like core (66), shown in FIG. 6(*b*), with the core being surfaced with a wear-resistant material (65*a*) such as alumina, flint or lined in either case. The shape of the ball is not limited to these two and may take any other shape provided that its core be of a ferromagnetic material.

Figure 7:
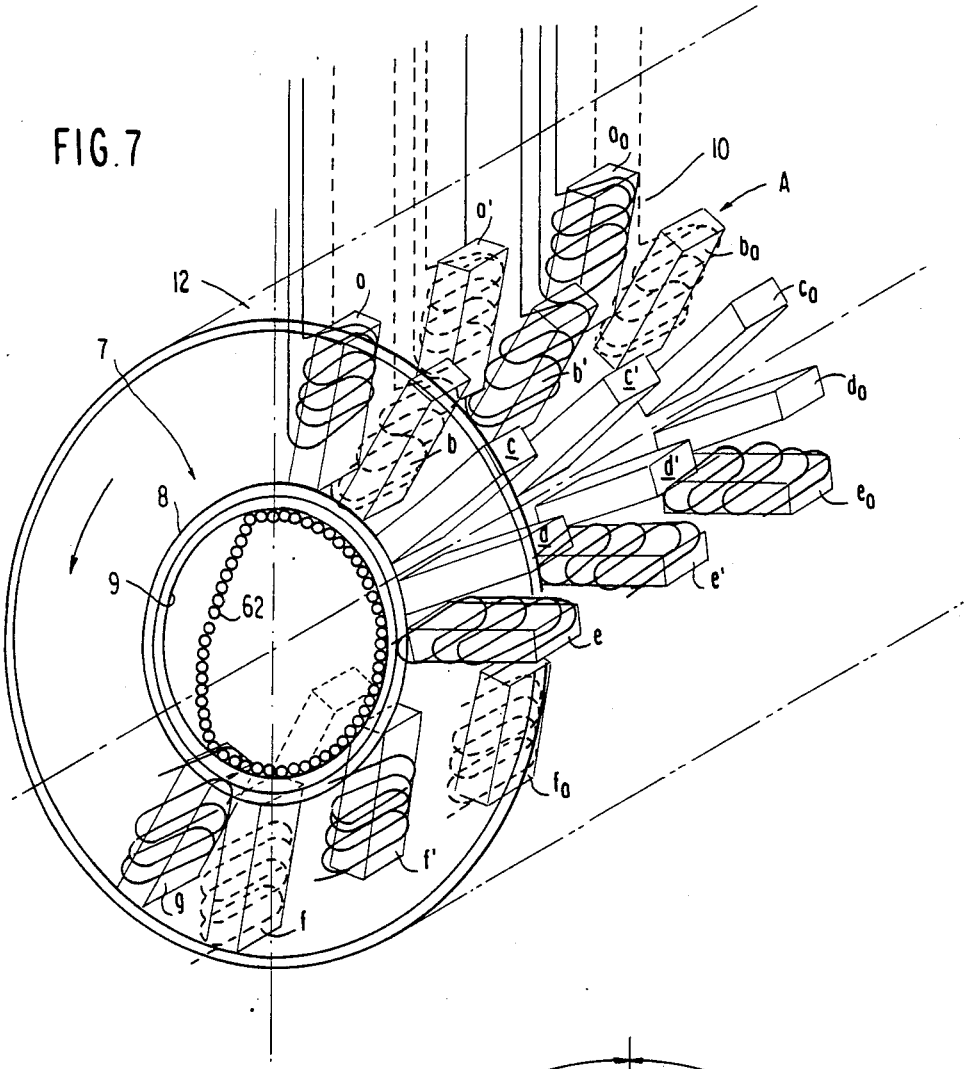
FIG. 7 is a perspective view showing schematically a mill embodying this invention.
Figure 8:
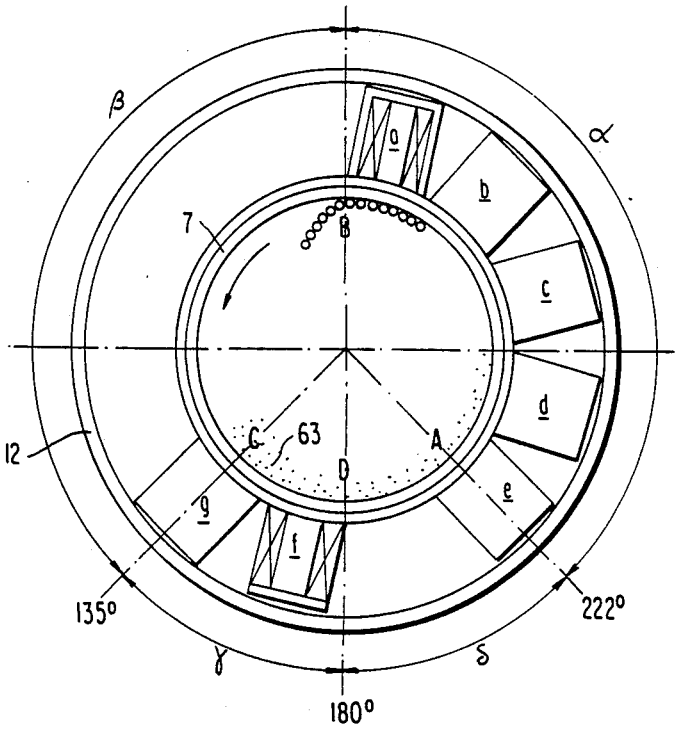
FIG. 8 is an end view of a mill shown in FIG. 7.

In one mode of the ball mill of this invention, the electromagents are distributed around the cylindrical casing and fixed in space with a small running clearance between the electromagnets and the casing, as shown in FIGS. 7 and 8, to which the following description refers.

Figure 9:
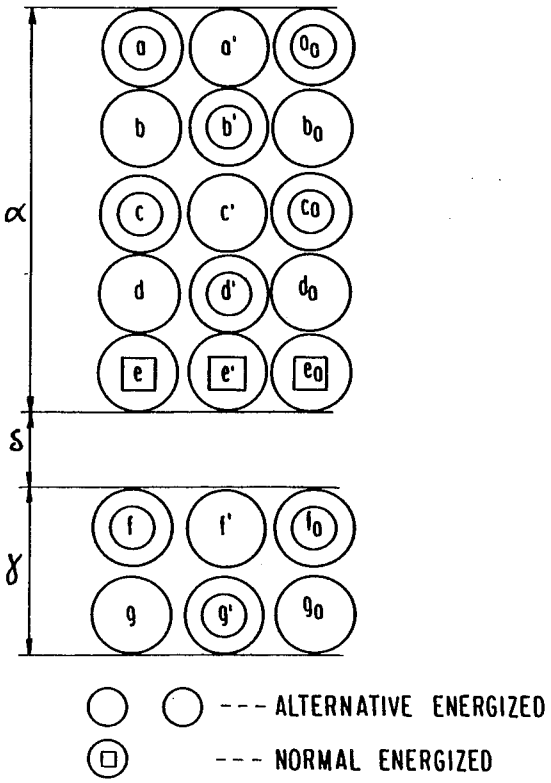
FIG. 9 is a developed view of a mill shown in FIG. 7.

Electromagnets (10) are mounted on and secured to the inner surface of support casing (12) concentric with cylindrical mill casing (7) whose outer wall (8) is non-magnetic but magnetically permeable and inner wall (9) is magnetically permeable and resistant to wear. They are arranged in a plurality of longitudinally extending rows parallel to the casing axis and spaced equally apart in circular direction, each row consisting of a plurality of electromagnets (10) spaced equally. The rows are located in two circular zones, first from about 135° to 180° and second from about 225° to 360° the top being 360° and the bottom being 180° as measured in the direction of casing rotation. In the indicated example, two rows (g) (f) are in the first zone ($\gamma$); rows (e), (d), (c), (b) and (a) are in the second zone ($\alpha$). Viewed sidewise, electromagnetics (10) are in longitudinal rows and circular columns; this orderly arrangement is shown in FIG. 9 in a developed view.

As far as energizing control over these electromagnets is concered, they are all in two electrical groups except for the lowermost row (e) in the second zone ($\alpha$). Electromagnets (e), (e'), (ea) and so on of row (e) are to be kept energized at all times during operation, and those in one group are to be energized while those in the other group are to be de-energized. In other words, the two groups are to be alternately and cyclically energized, such that, when any one magnet is turned on, its adjacent magnets, adjacent in circular and longitudinal directions, are turned off. This relationship is more clearly shown in the developed view of FIG. 9, in which those electromagnets marked with double circle constitute one group and those with single circle the other group. The cyclic timing is to be determined on the basis of the rotating speed of the cylindrical casing in the manner depicted in the timing diagram of FIG. 10, in which a certain point of the casing is indicated at A for the purpose of illustrating the method of energizing control required for this arrangement of electromagnetics (10).

Figure 10A:
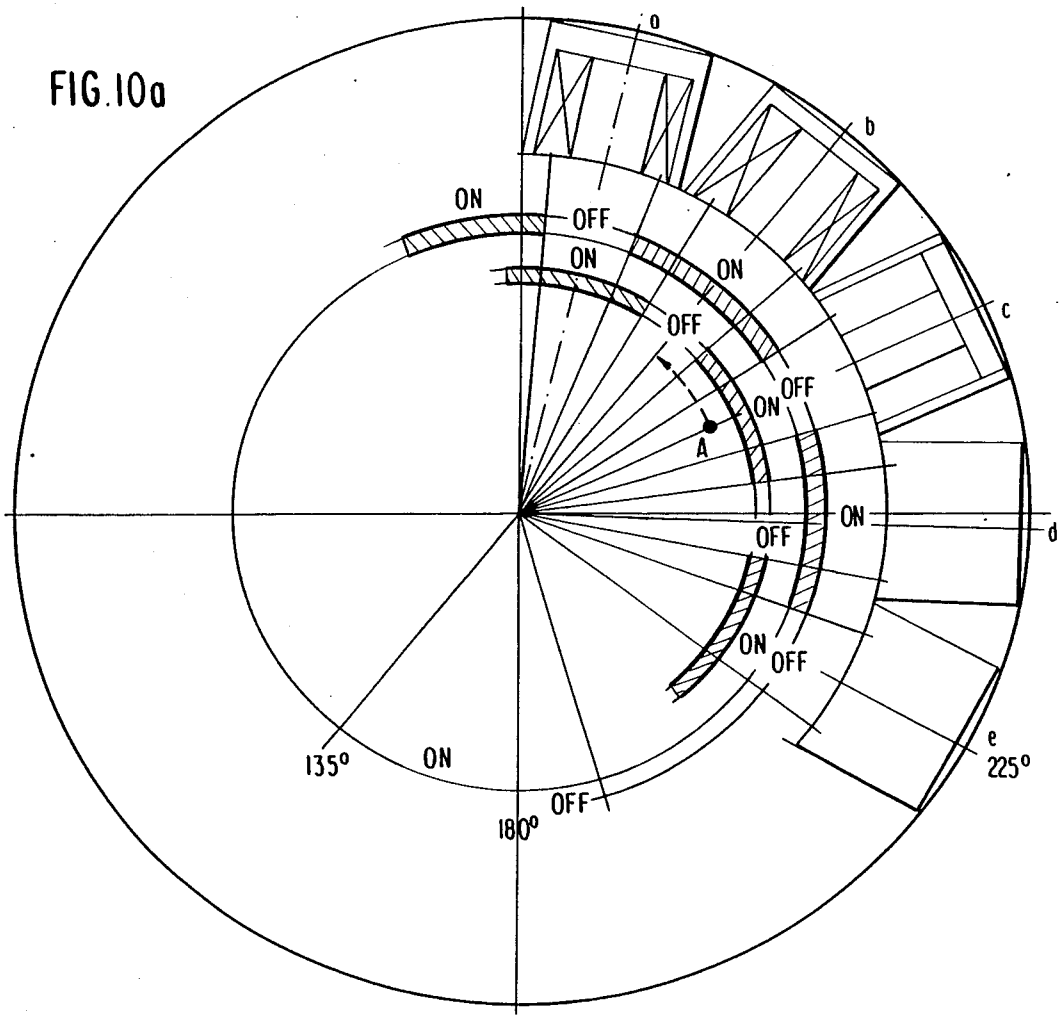
FIG. 10(*a*) is an end view of a mill showing timing of switch for energizing electromagnets.
Figure 10B:
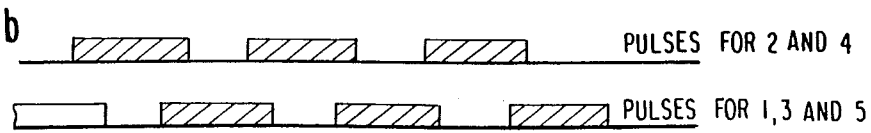

Suppose, in operation, point A is within the angular interval subtended by electromagnet (c), FIG. 10(*a*): while point A is moving in this interval, this electromagnet is kept energized and its adjacent electromagnets (b) and (d) are kept de-energized. As point A moves into the next interval for electromagnet (b), this electromagnet becomes energized and its adjacent ones (c) and (a) become de-energized.

Energizing current is in pulse form, as shown in FIG. (10) (b), in which the pulses for magnets (b) and (d) in the above description are actually for one group of magnets while those for magnets (a), (c) and (e) are for the other group. Because of the electrical inertia due to self-inductance of a closely wound electromagnet as is the case for the present magnets, the two kinds of pulse need to be slightly overlapped when the pulse for one group is followed by the pulse for the other group in the process of alternate energization.

Figure 11:
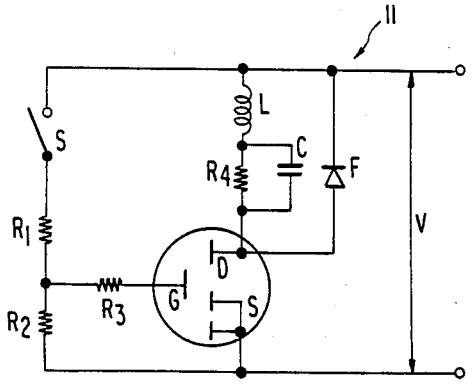
FIG. 11 is an electrical circuit for use in this invention.

This manner of alternate but slightly overlapped energization is to be accomplished by means of the network of switching circuits, one of which may be like the one shown in FIG. 11, wherein the circuit (11) is composed of a field-effect transistor, whose drain (D) is connected to magnet (L) through a parallel resistor-capacitor circuit ($R_4$), (C), gate (G) being connected to a mechanical switch (S) actuated in any of well-known manners by an element fixed to the rotary casing of ball mill (20), through voltage dividers ($R_1$), ($R_2$) and ($R_3$). Diode (F), parallel to magnet (L), serves to prevent the effect of electrical inertia from interfering with the scheme of alternate energization. Needless to say, the switch (S) may be supplanted by and electronic switch to be operated from a tachogenerator driven by the rotary casing or from a similarly driven rotary encoder through an amplifier as long as the switch is operated in step with the rotation of the casing.

The effect of electromagnets arranged and controlled as above will be explained in reference particularly to FIG. 8, in which four spatial positions inside cylindrical casing (7) are indicated at A, B, C and D. When the casing is rotating on its axis with its charge of balls and raw material (63) in free mixed state, balls suddenly experience strong pull at position A, where magnet row (e) is kept energized as stated before. The next moment, these balls come under the influence of row (d), every other magnet of which is in energized state, so that the same balls being pulled against the wall experience longitudinal pull, forward or rearward depending on their positional relationship to the energized magnets of row (d). This displaces the balls on the wall while they are being dragged upward. Similar displacement occurs when the balls come under the influence of row (c), and as they come near position B in zigzagging fashion, they begin to be hurled into space not all at once but randomly because the electromagnets or row (a) there too are alternately and cyclically turned on and off as shown in FIG. 9.

The particular balls under consideration thus fall along parabolic orbits, which are not necessarily perpendicular to the axis of the casing but may be at some angles simply because, even at the moment of their release from the casing wall at position B, they are subjected to longitudinal pull. The rotating speed of the casing is so set that these balls land on that part of casing wall at position C to crush the material by impact, shaking the particles off the wall surface and immediately coming under the influence of rows (7) and (6), whose magnets are alternately and cyclically turned on and off in the aforementioned manner. In this first zone ($\gamma$), too, the balls are magnetically forced to zigzag, thereby exerting shearing force to the material to add to the crushing action. It has been found by applicants that the pulverizing action of the balls being so dragged by the inner surface of the rotary casing and so forced to zigzag by the electromagnets can be intensified further by wiring them in such a way that the polarity of one magnet is the reverse of that of its adjacent magnets.

Figure 12:
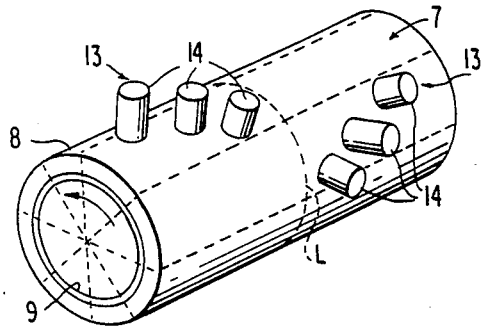
FIG. 12 is another perspective view of a mill embodying this invention.
Figure 13:
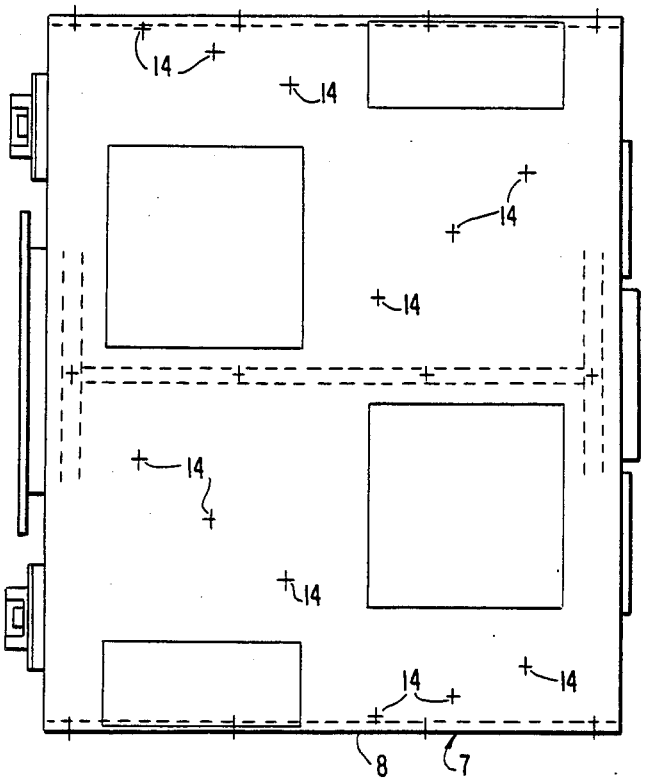
FIG. 13 is another side view of a pulverizing apparatus embodying this invention.
Figure 14:
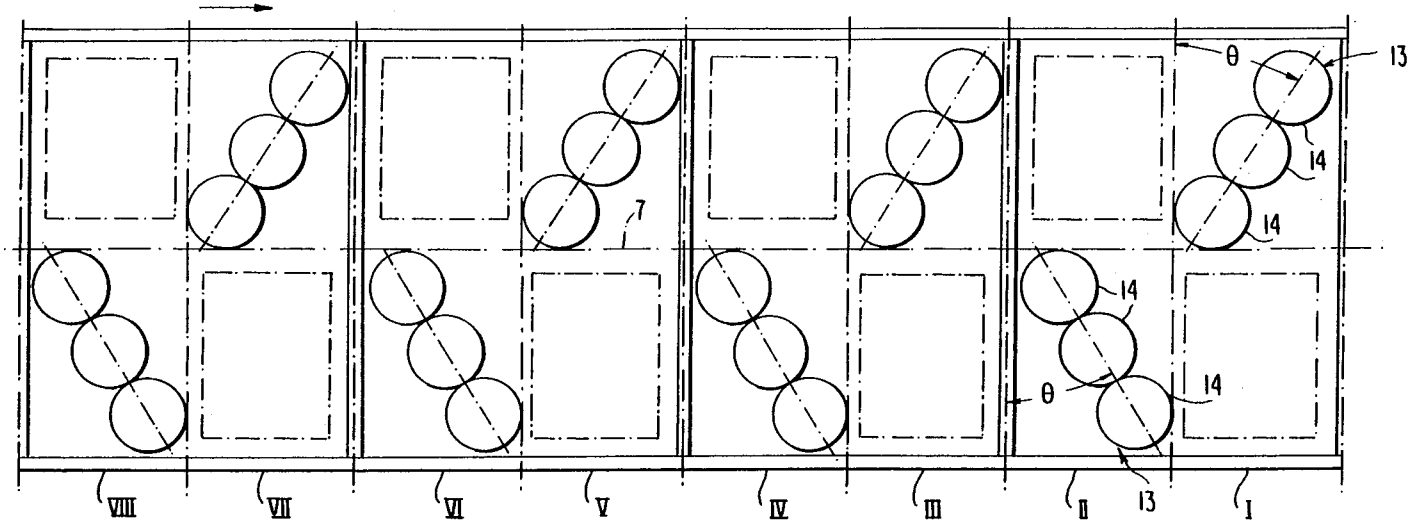
FIG. 14 is a developed view of the arrangement of electromagnets on the mill casing of FIG. 12.

In another mode of the ball mill of this invention, the pulverizing balls are set in a composite motion similar to, if not exactly the same as the foregoing manner, by means of a plurality of electromagnets mounted on and secured to the outer surface of cylindrical rotary casing (7), as shown in FIGS. 12, 13, 14, wherein the indicated example has eight rows of three electromagnets each, arranged in staggered fashion over the entire cylindrical surface of the casing (7), each row being extended diagonally from the imaginary circle drawn on the cylindrical surface to divide the casing (7) into two equal cylindrical halves, and terminated at the end of the cylindrical surface.

For the purpose of distributing these rows of electromagnets, the outer surface of casing (7) may be regarded as being divided by a total of eight longitudinal lines spaced equidistantly apart and parallel to the casing axis, so that the surface is demarcated into sixteen equal areas, 8 areas on each side of the halving circle mentioned above. A diagonal row of three electromagnets, extending from the halving circle in the direction of casing rotation, is set in every other area of the eight on each side, and the two groups of eight rows are staggered in such a way that there is only one row between two adjacent longitudinal lines, as will be seen in FIGS. 12, 13, 14 and 15, in which the rows are indicated at (13) and individual magnets at (14).

Experience has shown that the angle theta ($\theta$), between the longitudinal line and each row (13) should be anywhere between 30° and 45° although its magnitude depends on the size of pulverizing balls, the diameter of casing (7) and the kind of raw material to be pulverized.

Electromagnets (14), revolving with the casing, are to be sequentially energized and de-energized under control of a network of switching circuits, preferably one switching circuit for one electromagnet, external to but operating in step with the rotation of casing (7).

As in the preceding mode of the ball mill of this invention, casing (7) in rotary motion is to be viewed endwise through a spatially fixed circular scale centering on the casing axis; that is for the purpose of switching the electromagnets on and off according to a scheme similar to the one used in the preceding mode.

Figure 16:
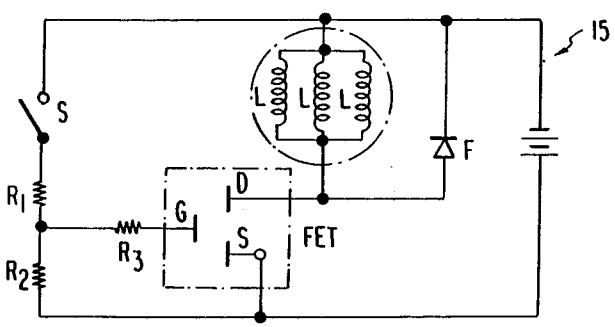
FIG. 16 is another electrical circuit used in this invention.

When casing (7) is in rotation, those rows (13) moving in and through two angular zones, from about 135° to 180° for the first zone and from about 225° to 360° or top point for the second zone, as read on the imaginary scale fixed in space, are to be kept energized. In short, the sixteen rows (13) are sequentially switched on and off as they revolve. An example of the switching circuit for this purpose is shown in FIG. 16, which is similar to the one indicated for the preceding mode but differs in that it serves one row of three magnets (14) instead of one magnet. Thus, a network of sixteen such switching circuits is required for this ball mill.

Figure 15:
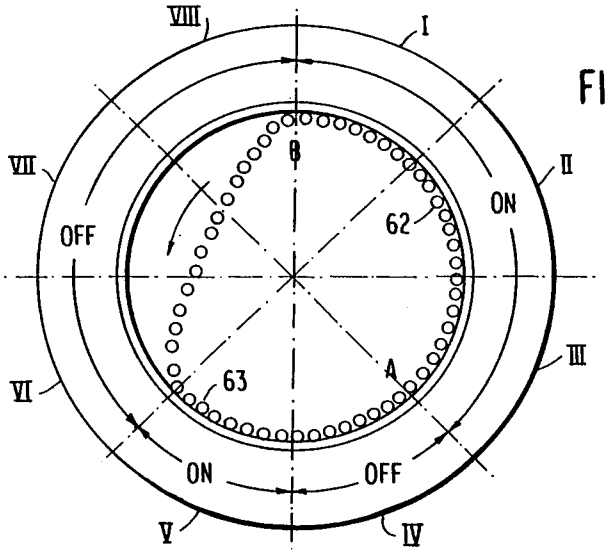
FIG. 15 is an end view showing movement of balls.

The effect of the electromagnet rows arranged and controlled as above will be explained in reference to FIG. 15, in which the angular scale is sectioned into equal intervals I through VIII, with section V corresponding to the first zone and sections III, II and I to the second zone. As the casing rotates in operation with its charge of balls (62) and raw material (63) in free state, the electromagnet rows revolving through the second zone exert magnetic pull to the balls there but, since the rows are staggered, they are urged in longitudinal direction, forward and rearward, and rise in the attracted and urged condition toward the top point B from the entry point A, as if they were pushed by the energized rows. At and near the top point B, the balls begin to be released and hurled into space, generally in an intermittently cascading manner, first by a row on one side of the dividing circle and next by another on the other side, thereby causing the balls to be mixed randomly when they fall upon those balls under the influence of energized rows in the first zone or section I. As in the case of the preceding mode, the distance of parabolic fall of the balls is much longer than when the balls fall merely by gravity and the impact with which they land is as strong.

FIG. 16 is another embodiment of an electric circuit applied to the apparatus shown in FIGS. 12 to 15, and the manner of energized the electromagnet is same as the circuit shown in FIG. 11. The three coils L of the magnets row 13 are connected in parallel and one terminal of each coil 13 is connected with plus terminal of a battery and another terminal is connected with a field effect transistor FET. When a switch S is opened, the coils L are energized. However, instead of the circuit 15, we can use another kind of a limit switch operated by a cam driven by the rotating shaft of the casing.

Further modifications and variations of the invention will be apparent to those skilled in the art from a study of the foregoing description and are intended to be encompassed by the claim appended hereto.

We claim:

1. A ball mill provided with balls inside said mill and adapted for the milling of material to produce a pulverized product, and having electromagnets as means for generating magnetic force acting on said balls, comprising:

a horizontally oriented rotary mill casing of a given longitudinal length and of cylindrical shape, and having two end heads and adapted to rotate in a direction of rotation, said mill casing being supported on and driven by two hollow shafts extending horizontally and in opposite directions along a center line of the mill casing, one shaft extending from one end head, and the other shaft extending from the second end head, one shaft being for admission of material to be pulverized in the mill, and the other shaft being for removal of resulting pulverized product from the mill in a gas-borne state;

a cylindrical stationary electromagnet-supporting casing concentric with and external to said rotary mill casing, the circumference of said stationary casing being scaled in degrees in the direction of rotation of said mill casing, with the point of 0° being at the highest point of said stationary casing , only two zones of electromagnets being supported at an inner side of said stationary casing, said zones extending along the total overall longitudinal length of said mill-casing, one zone being from approximately 135° to 180° and the other zone being from approximately 225° to 360° in circumference;

each zone comprising a plurality of identically constructed electromagnets, each electromagnet being solidly mounted on and secured to the inner surface of said stationary casing with each of their magnetic pole axes being aligned perpendicularly to said center line of said mill casing and with a uniform running clearance provided between each electromagnet and said mill casing, the electromagnets being equally spaced apart and located at and distributed throughout said two zones so that longitudinal rows and circumferential rows of the electromagnets are formed in said two zones, and said electromagnets consisting of three electrical groups, the first group consisting of electromagnets distributed on one longitudinal row at approximately 225°, the second group consisting on one-half of the electromagnets that are not part of said first group, and the third group consisting of one-half of the electromagnets that are not part of said first group and are not said second group, said electromagnets of said second and third groups being arranged in a staggered manner so that an electromagnet of the second group is circumferentially immediately and longitudinally immediately adjacent to an electromagnet of the third group to form a zig zag arrangement, and means for energizing the electromagnets so that when any one electromagnet of said second and third groups is energized, the electromagnets of said second and third groups immediately next to it in circumferential and longitudinal directions are de-energized;

and a network of electrical circuits which control the electromagnets, said network consisting of three circuit groups corresponding to said three electromagnet groups, the first circuit group serving the first electromagnet group to keep this group suitably energized at all times, and the second and third circuit groups serving each of said second and third electromagnet groups to alternately and cyclically energize said second and third electromagnet groups.

* * * * *